US008914922B1

(12) United States Patent
Wells et al.

(10) Patent No.: US 8,914,922 B1
(45) Date of Patent: Dec. 23, 2014

(54) MOUNTABLE FAN FOR MASSAGE TABLE

(76) Inventors: Charles D. Wells, Dufur, OR (US); Wanda L. Wells, Dufur, OR (US)

( * ) Notice: Subject to any disclaimer, the term of this patent is extended or adjusted under 35 U.S.C. 154(b) by 356 days.

(21) Appl. No.: 13/432,986

(22) Filed: Mar. 28, 2012

(51) Int. Cl.
*A61H 37/00* (2006.01)
*A61M 11/00* (2006.01)
*A47C 21/04* (2006.01)

(52) U.S. Cl.
CPC ..... *A47C 21/044* (2013.01)
USPC ..... 5/423; 5/652.2; 5/636; 5/638; 5/643; 5/725; 601/24; 601/156; 601/160

(58) Field of Classification Search
CPC ..... A61G 13/108; A61G 13/009; A61G 2201/102; A47C 21/044; F24F 2221/38
USPC ..... 5/600, 622, 632, 636–641, 643, 652.1, 5/652.2, 724–726, 933, 941, 944, 421, 5/423, 655; 601/24, 154, 156, 160
See application file for complete search history.

(56) References Cited

U.S. PATENT DOCUMENTS

| | | | | | |
|---|---|---|---|---|---|
| 2,924,216 | A | | 2/1960 | Stewart | |
| 2,962,022 | A | * | 11/1960 | Courtin | 601/16 |
| 3,358,382 | A | * | 12/1967 | Glintz | 34/99 |
| 3,385,036 | A | * | 5/1968 | Webb | 55/418 |
| 3,490,443 | A | * | 1/1970 | Decupper | 601/11 |
| 3,923,482 | A | * | 12/1975 | Knab et al. | 55/412 |
| 3,928,876 | A | | 12/1975 | Starr | |
| 4,140,105 | A | * | 2/1979 | Duvlis | 128/847 |
| 5,305,483 | A | * | 4/1994 | Watkins | 5/638 |
| 5,317,767 | A | * | 6/1994 | Hargest et al. | 5/725 |
| 5,389,037 | A | * | 2/1995 | Hale | 454/284 |
| 5,713,834 | A | * | 2/1998 | Palmer | 601/149 |
| 6,023,801 | A | * | 2/2000 | Lamm | 5/636 |
| 6,146,412 | A | * | 11/2000 | Van Duren | 607/107 |
| 6,668,407 | B1 | * | 12/2003 | Reitzel | 5/656 |
| 6,689,155 | B2 | | 2/2004 | Gammons et al. | |
| 7,037,188 | B2 | * | 5/2006 | Schmid et al. | 454/187 |
| 7,543,583 | B2 | | 6/2009 | Acton | |
| 7,694,370 | B1 | * | 4/2010 | Lee | 5/632 |
| 7,753,977 | B2 | * | 7/2010 | Lyons et al. | 55/385.1 |
| 7,908,688 | B2 | * | 3/2011 | Tompkins | 5/423 |
| 8,122,540 | B2 | * | 2/2012 | Ardis | 5/423 |
| 8,353,069 | B1 | * | 1/2013 | Miller | 5/423 |
| 8,444,747 | B2 | * | 5/2013 | Kristensson et al. | 95/14 |
| 8,468,628 | B1 | * | 6/2013 | Cheng | 5/641 |
| 2003/0150328 | A1 | * | 8/2003 | Hansson et al. | 95/273 |
| 2010/0101418 | A1 | * | 4/2010 | Augustine et al. | 95/273 |
| 2010/0204760 | A1 | * | 8/2010 | Lawliss | 607/83 |
| 2011/0247612 | A1 | * | 10/2011 | DeSalvo | 128/200.23 |
| 2012/0142999 | A1 | * | 6/2012 | Albu et al. | 600/26 |
| 2013/0254999 | A1 | * | 10/2013 | Foch | 5/639 |
| 2014/0100490 | A1 | * | 4/2014 | Chelgren | 601/24 |

* cited by examiner

*Primary Examiner* — Nicholas Polito
*Assistant Examiner* — David R Hare
(74) *Attorney, Agent, or Firm* — Crossley Patent Law

(57) ABSTRACT

A mountable fan for massage table that is removably installable to an underside of an extant massage table headrest, said mountable fan for massage table having a generally ovoid hoop with an upper surface and a lower surface, a vent circumferentially disposed around the upper surface, a fan chamber radially disposed from the hoop, an electric fan disposed within the fan chamber, and an intake duct with a removable filter disposed therein, the intake duct disposed on the fan chamber, whereby air is drawn into the intake duct by the fan and forcibly expelled through the vent to relaxingly stimulate the face of a patient lying on the massage table.

8 Claims, 5 Drawing Sheets

MOUNTABLE FAN FOR MASSAGE TABLE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of mountable fans and forced air massage devices are known in the prior art. However, what is needed is a mountable fan for massage table that is removably installable to an underside of an extant massage table headrest, said mountable fan for massage table having a generally ovoid hoop with an upper surface and a lower surface, a vent circumferentially disposed around the upper surface, a fan chamber radially disposed from the hoop, an electric fan disposed within the fan chamber, and an intake duct disposed on the fan chamber, the intake duct having a removable filter disposed therein, whereby air is drawn into the intake duct by the fan and forcibly expelled through the vent to relaxingly stimulate the face of a patient lying on the massage table.

FIELD OF THE INVENTION

The present invention relates to a mountable fan for massage table, and more particularly, to a mountable fan for massage table that is removably installable to an underside of an extant massage table headrest, said mountable fan for massage table having a generally ovoid hoop with an upper surface and a lower surface, a vent circumferentially disposed around the upper surface, a fan chamber radially disposed from the hoop, an electric fan disposed within the fan chamber, and an intake duct disposed on the fan chamber, the intake duct having a removable filter disposed therein, whereby air is drawn into the intake duct by the fan and forcibly expelled through the vent to relaxingly stimulate the face of a patient lying on the massage table.

SUMMARY OF THE INVENTION

The general purpose of the mountable fan for massage table, described subsequently in greater detail, is to provide a mountable fan for massage table which has many novel features that result in a mountable fan for massage table which is not anticipated, rendered obvious, suggested, or even implied by prior art, either alone or in combination thereof.

The present mountable fan for massage table is considered for use with an extant massage table. Typical massage tables have a removable headrest generally disposed in a U-shape, the headrest configured to cradle the face of a patient lying prone on the table to receive treatment thereon, the headrest supporting the forehead and aligning the vertebrae in the neck. The present device is installable to an underside of the headrest of an extant massage table, to provide additional relief for a patient receiving treatment thereupon.

The present device uses forced air to relaxingly stimulate the face of a patient using the device. A further application of the device is for use during aromatherapy; a scent may be added to a removable filter disposed in an intake duct, and the scent thereby borne in the air forcibly driven through the device. The directed airflow and the use of scents relax the patient and increase the benefit of therapy for a patient receiving treatment on an extant massage table to which the present device is installed.

The instant mountable fan for massage table includes a hollow, generally ovoid hoop having an upper surface and a lower surface. A vent is disposed circumferentially around the upper surface. A plurality of attachment brackets are radially disposed outwards from the upper surface. Each of the plurality of attachment brackets is spaced equidistantly from one another, and includes a parallelepiped member having a hole centrally disposed therein. A fastener is releasably inserted through the hole to removably install the device to an underside of an extant massage table headrest.

A fan compartment is disposed radially outward from the hoop. A fan is disposed inside the fan compartment. When the fan is activated an airflow is directed through the fan compartment and into the hoop, the air forcibly directed through the vent. This air relaxingly stimulates the face of a person lying on the extant massage table when the person is lying on the table in the typical fashion.

A generally cylindrical intake duct is disposed on the fan compartment, radially projecting away from the hoop. The intake duct has an infundibular section and an entrance. The infundibular section converges into the fan chamber. The infundibular section increases the speed of the airflow through the intake duct and into the fan chamber, when the fan is activated.

A filter is removably disposed in the entrance of the intake duct. Extant aromatic scents used in aromatherapy may be added to the filter, as desired. When scent is added to the filter, the scent is borne with the air forcibly directed through the device by means of the fan, and the scent is vented through the vent in the upper surface of the hoop proximal to the face of a patient using the device.

Thus has been broadly outlined the more important features of the present mountable fan for massage table so that the detailed description thereof that follows may be better understood and in order that the present contribution to the art may be better appreciated.

Objects of the present mountable fan for massage table, along with various novel features that characterize the invention are particularly pointed out in the claims forming a part of this disclosure. For better understanding of the mountable fan for massage table, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
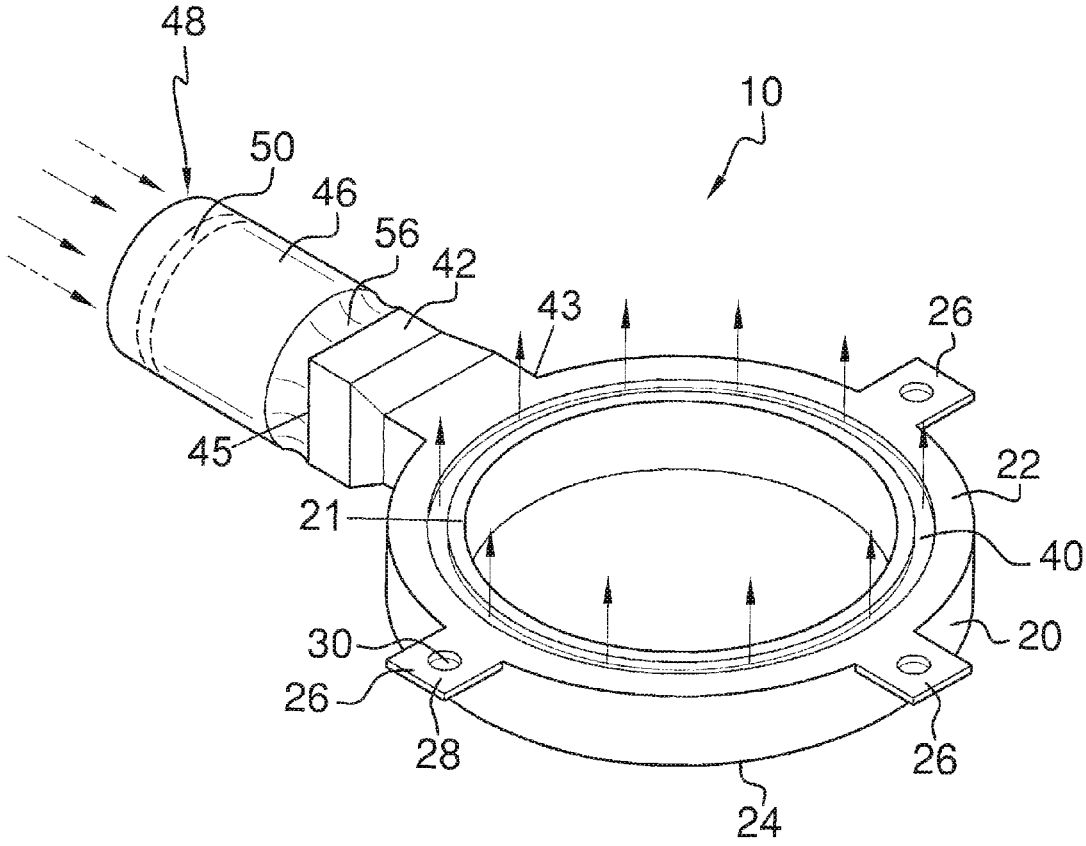
FIG. 1 is an isometric view.
Figure 2:
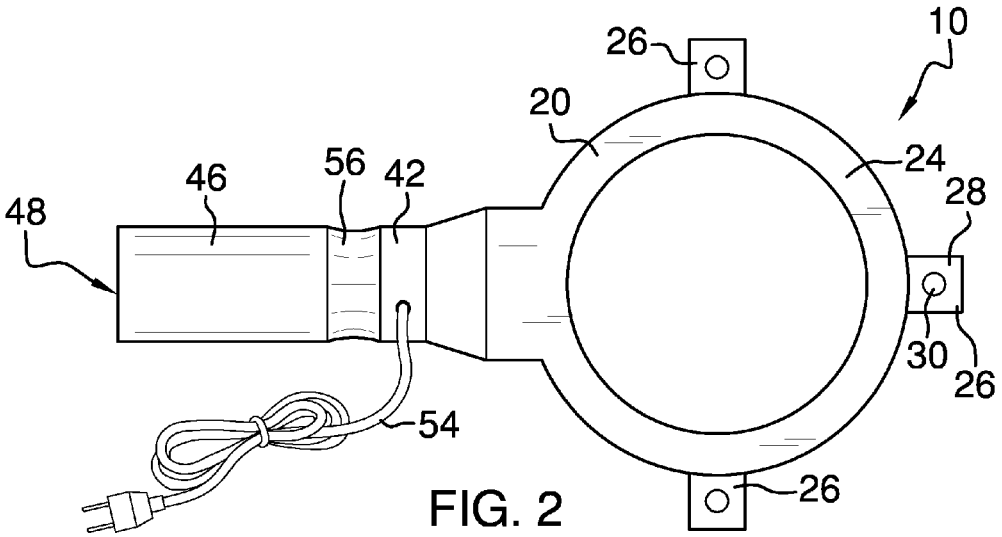
FIG. 2 is a bottom view.
Figure 3:
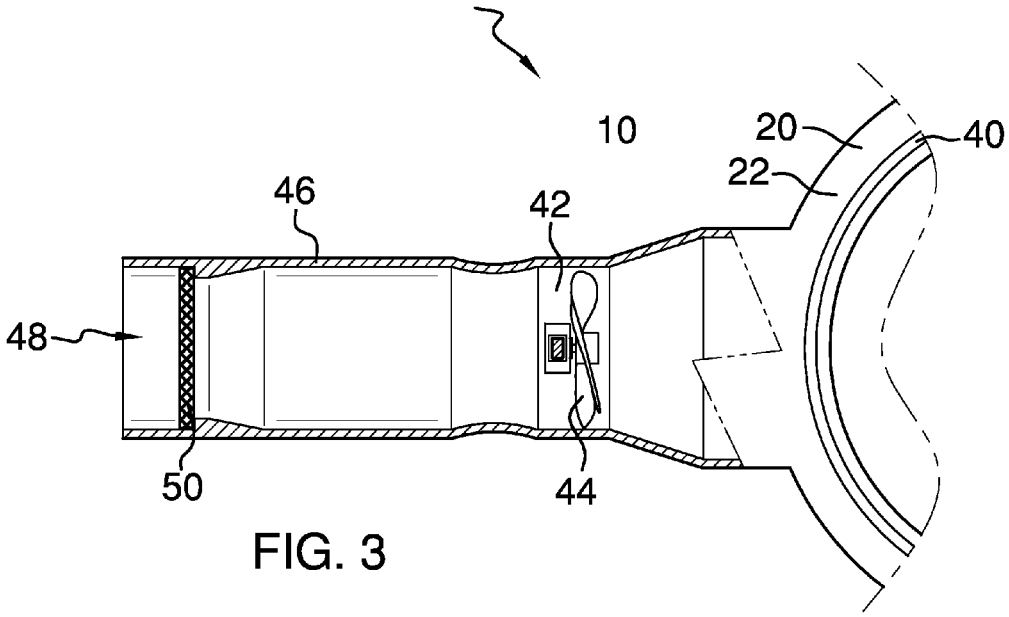
FIG. 3 is a top view with a cutaway view of a fan compartment and an intake duct.
Figure 4:
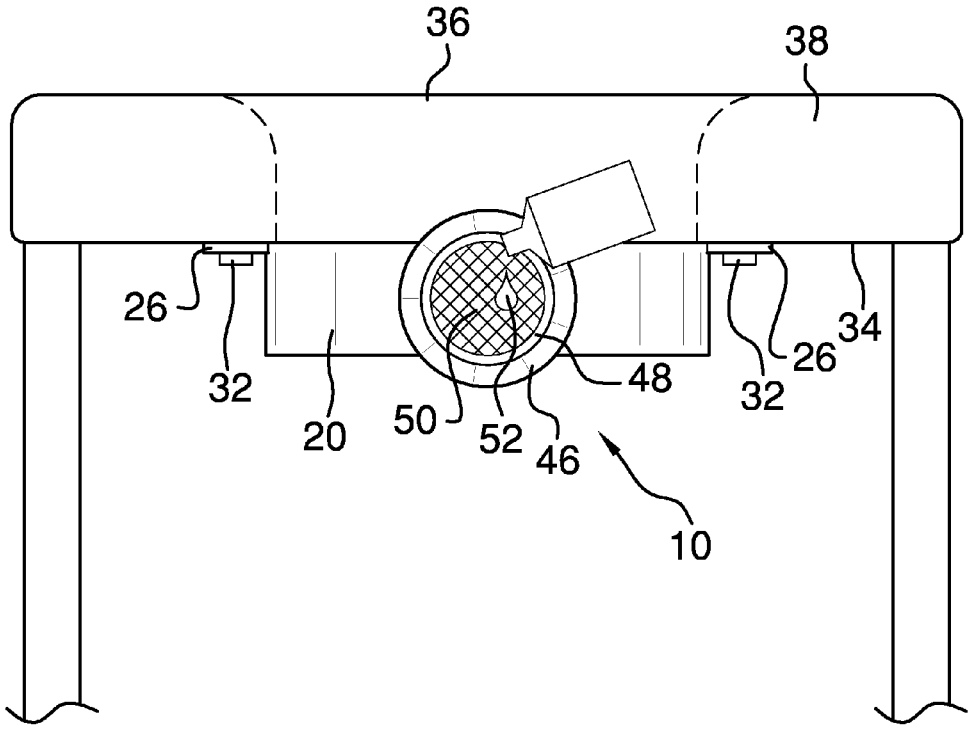
FIG. 4 is a front in-use view with the mountable fan for massage table installed upon an underside of an extant massage table headrest.
Figure 5:
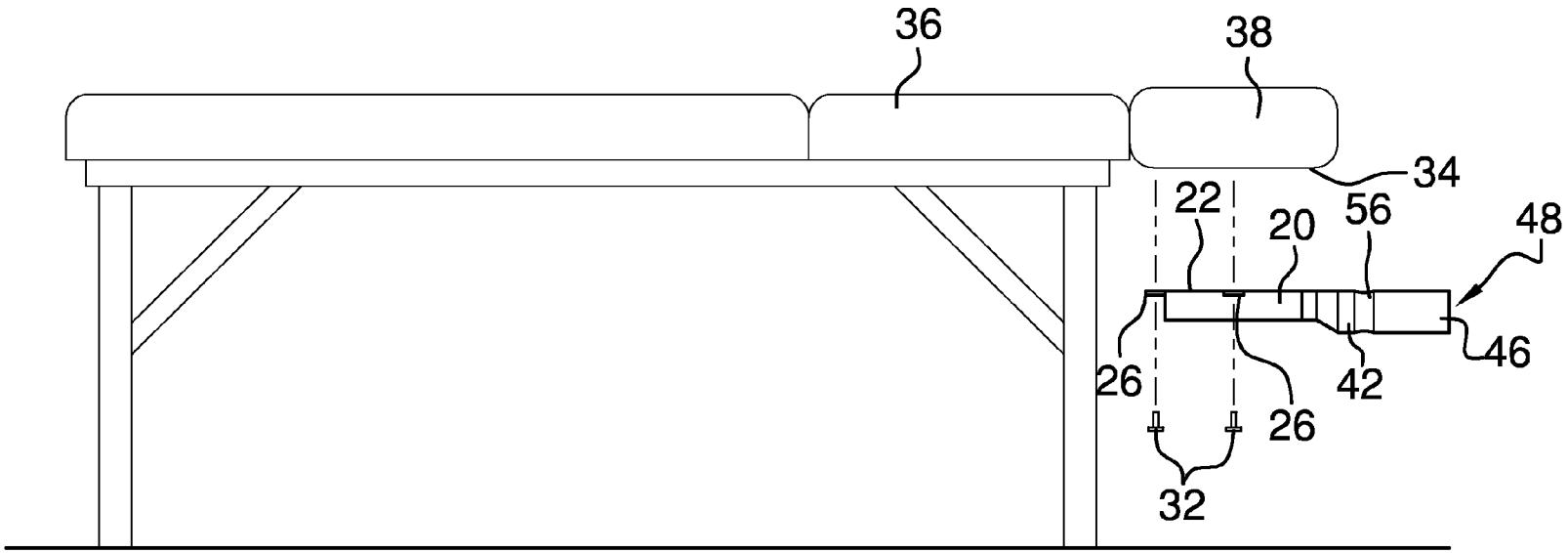
FIG. 5 is an exploded side view detailing the installation of the device to an underside of an extant massage table headrest.
Figure 6:
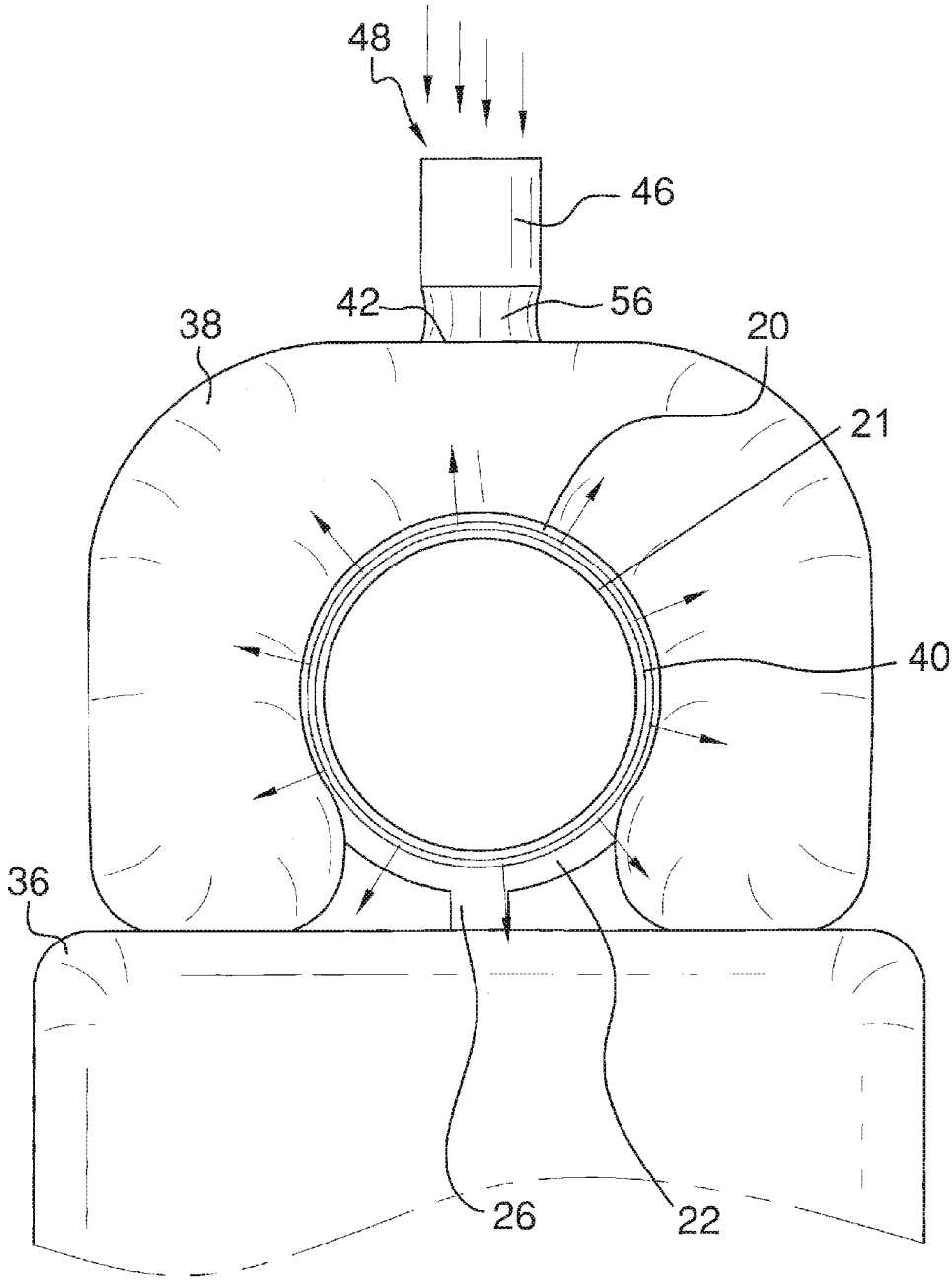
FIG. 6 is a top in-use view with the device installed on the underside of an extant massage table headrest.

With reference now to the drawings, and in particular FIGS. 1 through 6 thereof, example of the instant mountable fan for massage table employing the principles and concepts of the present mountable fan for massage table and generally designated by the reference number 10 will be described.

Referring to FIGS. 1 through 6 a preferred embodiment of the present mountable fan for massage table 10 is illustrated.

The mountable fan for massage table 10 is considered for use with an extant massage table 36. Typical massage tables 36 have a headrest 38 generally disposed in a U-shape, the headrest 38 surrounding an aperture into which the face of a patient is placed when lying prone on the massage table 36 to receive treatment. The present mountable fan for massage table 10 releasably attaches to an underside 34 of the headrest 38, and forcibly directs an airflow upward to provide additional relief for a patient lying and receiving treatment upon the massage table 36, as will be described subsequently in this detailed description.

The mountable fan for massage table 10 includes a hollow ovoid hoop 20 having a circular central opening 21, an upper surface 22 and a lower surface 24. A plurality of attachment brackets 26 is radially disposed outwardly from the hoop 20 upper surface 22. Each of the plurality of attachment brackets 26 includes a parallelepiped member 28 with a hole 30 centrally disposed therein, said hole 30 configured to releasably receive a fastener 32 therethrough. The ovoid hoop 20 is installable to an underside 34 of an extant massage table 36 headrest 38 by the plurality of attachment brackets 26. The central opening 21 has a size configured to conform to an aperture of the massage table 36 head rest 38.

When installed to the underside 34 of an extant massage table 36 head rest 38, the upper surface 22 of the hoop 20 is disposed underlying the aperture of the headrest 38. A vent 40 is disposed continuously along the hoop 20 upper surface 22, said vent 40 proximal the face of a patient—when the patient is lying on the massage table 36 in the normal fashion, with their face cradled by the headrest 38.

A fan chamber 42 is radially disposed outwardly from the hoop 20. The fan chamber 42 has a front side 43 in fluid communication with the hoop 20 and further having a rear side 45. An electric fan 44 is disposed entirely within the fan chamber 42. The fan 44 forcibly conveys air through the fan chamber 42 and expels an airflow through the vent 40. Air is thusly forcibly discharged proximal the face of a patient using the device 10, the patient lying on the extant massage table 36 in the typical fashion, with the face downward, cradled by the headrest 38.

An intake duct 46 is disposed on the rear side 45 of the fan chamber 42, the intake duct 46 having an entrance 48. A filter 50 is removably disposed in the intake duct 46 entrance 50. This filter 50 is devised to be interchangeable for use with extant aromatherapy scents 52. When a scent 52 is added to the filter 50, the scent 52 is borne with the air forcibly through the mountable fan for massage table 10 and may provide additional relief for a patient using the device 10.

This filter 50 is devised to be interchangeable for use with extant aromatherapy scents 52. When a scent 52 is added to the filter 50, the scent 52 is borne with the air forcibly through the mountable fan for massage table 10 and may provide additional relief for a patient using the device 10.

The intake duct 46 is generally cylindrical and has a diameter larger than the fan chamber. The intake duct 46 has an infundibular section 56 converging into the fan chamber 42, by which infundibular section 56 the intake duct 46 is connected to the fan chamber 42. This infundibular section 56 speeds airflow into the fan chamber 42 and thusly decreases pressure within the fan chamber 42. Air is thereby more forcibly expelled through the vent 40 in the upper surface 22 of the hoop 20.

A cord 54 is included, the cord 54 interconnecting the fan 44 in circuit with an external power source, as desired for operation of the device 10. The mountable fan for massage table 10 is therefore removably attachable to the underside 34 of an extant massage table 36 head rest 38, the filter 50 is removable and interchangeable for use with a plurality of extant aromatherapy scents 52, and air drawn in through the intake duct 46 is forcibly directed through the vent 40 by means of the fan 44 to provide additional relief to a patient relaxing on the massage table 36 or receiving treatment thereon.

What is claimed is:

1. A mountable fan for massage table comprising:
- a hollow, ovoid hoop having a circular central opening, an upper surface and a lower surface;
- a fan chamber disposed upon the hoop, the fan chamber having a front side in fluid communication with the hoop and further having a rear side;
- an electric fan disposed entirely within the fan chamber;
- an intake duct disposed on the rear side of the fan chamber, the intake duct having an entrance;
- a filter removably disposed in the intake duct entrance;
- a vent disposed continuously along the hoop upper surface;
- wherein the ovoid hoop is removably attachable to an underside of an extant massage table head rest, the central opening has a size configured to conform to an aperture of the massage table head rest, and air drawn in through the intake duct is forcibly directed through the vent by the fan.

2. The mountable fan for massage table of claim 1 wherein the ovoid hoop further comprises a plurality of attachment brackets disposed equidistantly around the hoop, each of the plurality of attachment brackets comprising a parallelepiped member projecting radially from the hoop upper surface, wherein a hole is centrally disposed in each of the plurality of attachment brackets, said hole configured to releasably receive a fastener therethrough.

3. The mountable fan for massage table of claim 2 wherein the fan chamber is disposed radially from the hoop in the same plane as the hoop.

4. The mountable fan for massage table of claim 3 wherein the intake duct is contiguous with the fan chamber, the intake duct disposed outwardly from the fan chamber.

5. The mountable fan for massage table of claim 4 wherein the intake duct further comprises an infundibular section converging into the fan chamber, said infundibular section speeding the airflow through the fan chamber when the fan is activated.

6. The mountable fan for massage table of claim 5 further comprising a cord connecting the fan in circuit to a power source.

7. The mountable fan for massage table of claim 6 wherein the filter is removable and interchangeable, wherein the filter is configured to receive at least one of a plurality of aromatherapy essences thereon.

8. A mountable fan for massage table comprising:
- a hollow ovoid hoop having a circular central opening, an upper surface and a lower surface;
- a plurality of attachment brackets radially disposed outwardly from the hoop upper surface, each of the plurality of attachment brackets comprising a parallelepiped member with a hole centrally disposed therein, said hole configured to releasably receive a fastener therethrough;

a fan chamber radially disposed outwardly from the hoop, the fan chamber having a front side in fluid communication with the hoop and further having a rear side;

an electric fan disposed entirely within the fan chamber;

an infundibular section flared outwardly from the rear side of fan chamber;

a generally cylindrical intake duct disposed on the infundibular section, the intake duct having an entrance;

a filter removably disposed in the intake duct entrance;

a vent disposed continuously along the hoop upper surface;

a cord interconnecting the fan in circuit with an external power source;

wherein the ovoid hoop is removably attachable to an underside of an extant massage table head rest, the central opening has a size configured to conform to an aperture of the massage table head rest, the filter is removable and interchangeable and is configured to receive at least one of a plurality of extant aromatherapy scents thereon, and air drawn in through the intake duct is forcibly directed through the vent by the fan.

* * * * *